United States Patent [19]

Mattia et al.

[11] Patent Number: 5,033,632

[45] Date of Patent: Jul. 23, 1991

[54] TAMPER-EVIDENT CLOSURE WITH ANGLED BREAKAWAY TABS

[75] Inventors: Daniel Mattia, Union; Edward J. Drozd, Lake Hiawatha; Vincent Comitini, Westfield, all of N.J.

[73] Assignee: Lincoln Mold and Die Corporation, Roselle, N.J.

[21] Appl. No.: 535,435

[22] Filed: Jun. 8, 1990

[51] Int. Cl.[5] ..... B65D 41/34

[52] U.S. Cl. ..... 215/252; 215/258

[58] Field of Search ..... 215/252, 258, 218, 221

[56] References Cited

U.S. PATENT DOCUMENTS

| | | | |
|---|---|---|---|
| 3,455,478 | 7/1969 | Fields et al. | 215/252 |
| 4,180,174 | 12/1979 | Quinn | 215/221 |
| 4,471,878 | 9/1984 | Davis et al. | 215/258 X |
| 4,505,401 | 3/1985 | Berglund | 215/252 |
| 4,573,601 | 3/1986 | Berglund | 215/252 |
| 4,828,127 | 5/1989 | Young et al. | 215/252 |

*Primary Examiner*—Stephen Marcus
*Assistant Examiner*—Vanessa M. Roberts
*Attorney, Agent, or Firm*—Caesar, Rivise, Bernstein, Cohen & Pokotilow, Ltd.

[57] ABSTRACT

A tamper-evident closure includes a cap having an interior, threaded peripheral skirt, a tamper-evident ring disposed below the lower edge of the skirt and a plurality of elongate bridge members interconnecting the tamper-evident ring to the cap. Each bridge member includes a lower end forming a lower juction with the ring an upper end thinner than the lower end forming an upper juction with a surface of a recess formed in the skirt. Each bridge member is designed to break at the upper end thereof when the closure is rotated in a direction to remove it from the container, and each bridge member is inclined upwardly at an acute angle to the ring from the lower to the upper junction, in the direction in which the cap is required to be rotated to remove it from the container. Each of the bridge members has a stepped configuration for providing a bridge surface closely spaced to and facing the surface of the recess at which the upper junction is formed for engaging this latter surface when the cap is being rotated to secure the closure to the container.

3 Claims, 3 Drawing Sheets

FIG. 3
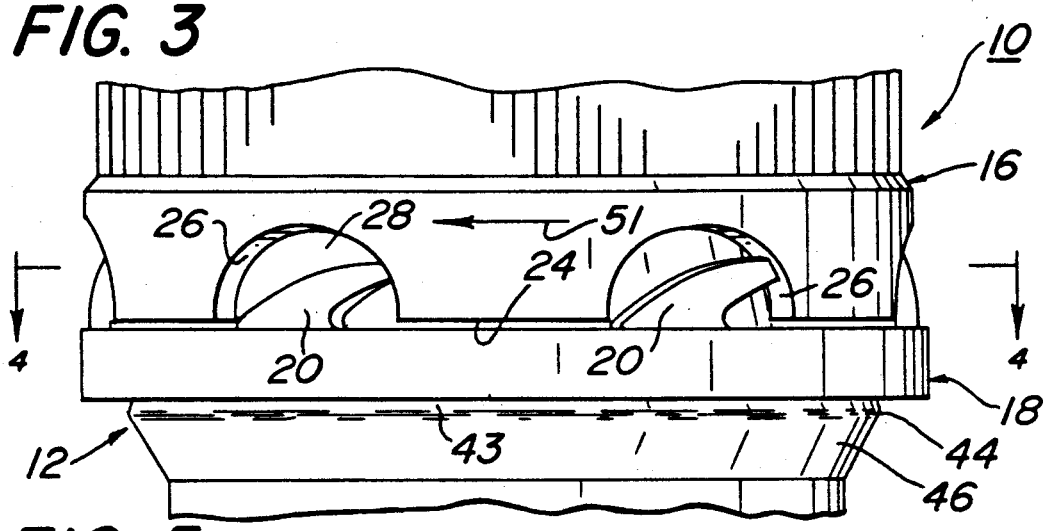
FIG. 5
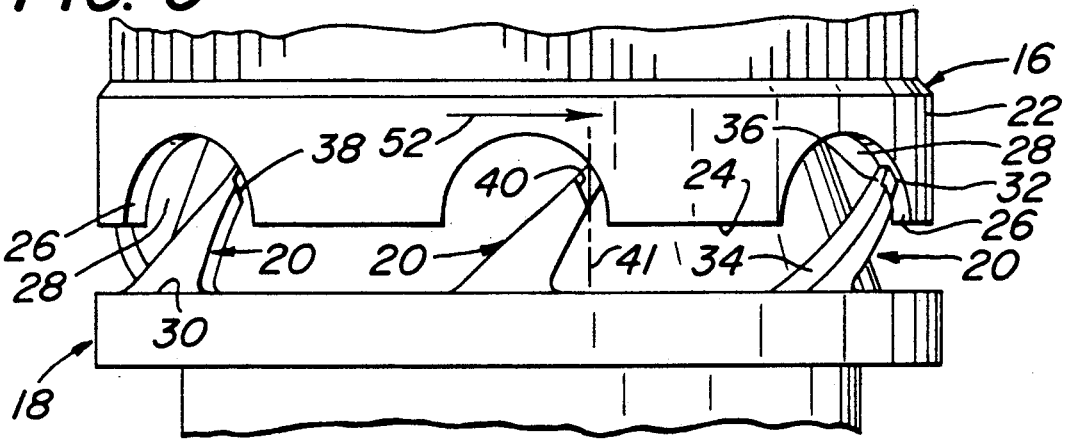
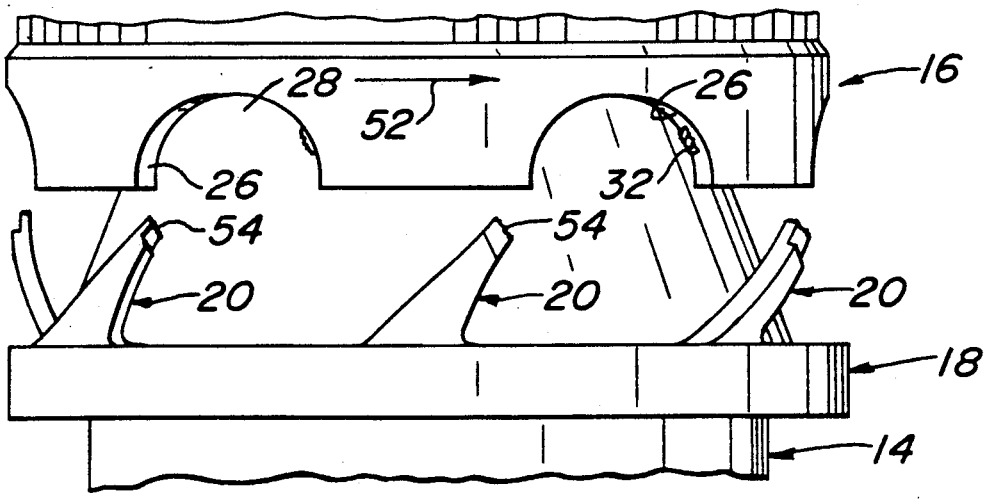
FIG. 6

TAMPER-EVIDENT CLOSURE WITH ANGLED BREAKAWAY TABS

FIELD OF THE INVENTION

This invention relates generally to closures for containers, and more specifically to a tamper-evident closure of the type have a cap, a tamper-evident ring and breakaway bridges or tabs interconnecting the cap and ring.

BACKGROUND ART

The prior art is replete with disclosures of tamper-evident closures, formed of a cap, a tamper-evident ring and a plurality of circumferentially spaced-apart breakaway bridges or tabs interconnecting the cap and ring. One of the problems encountered in the design of such tamper-evident closures is the premature breakage of the tabs or bridge members during a capping operation, in which the closure is being applied to a container.

One solution to the problem of premature breakage of the tabs is suggested in U.S. Pat. No. 3,455,478, issued to Fields et al. In the design disclosed in that patent the breakaway tabs or bridge members are inclined in a direction which subjects them to compressive forces when the closure is rotated in a clockwise direction during capping, and which subjects them to tensile forces, which breaks them, when the cap is unscrewed in a counterclockwise direction.

Although the concept disclosed in the Fields et al. '478 patent is very desirable, there is no arrangement provided for actually limiting the amount of compressive force imposed upon the bridge members during the capping operation. This can result in the premature fracture of the bridges and/or the undesired distortion of the tamper-evident ring as it is snapped over a retaining bead on a container during a capping operation.

U.S. Pat. No. 4,505,401, issued to Berglund, also discloses a tamper-evident closure of the type employing inclined bridges between a threaded cap section and an underlying tamper-evident ring. In the embodiment shown in FIG. 3 of the Berglund '401 patent cooperating engagement means, generally referred to by the numeral 11, are provided to insure that the tamper-evident ring is entrained rotationally with the cap when the cap is being screwed onto a container. These engagement means include one or more teeth 12 on the edge of the cap skirt engaging with one or more corresponding notches 13 on the tamper-evident ring. Although this arrangement limits the amount of force imposed upon the breakaway tabs 7 during the capping operation, it is a somewhat complex arrangement, requiring the formation of interlocking members which are separate and apart from the inclined breakaway tabs.

U.S. Pat. No. 4,828,127, issued to Young et al, discloses another arrangement for securing a tamper-evident ring to a threaded cap member by inclined breakaway tabs. In this arrangement, as can be seen best in FIG. 5, the substantially vertical edge 9, provided as part of each recess 8, cooperates with a confronting vertical surface of a tooth 11 to prevent the imposition of excessive forces upon the webs 12 during a capping operation. In particular, the confronting surfaces engage each other to thereby cause the cap and retaining ring to move as a single unit during the capping operation, prior to imposing, on the interconnecting webs 12, an excessive force which will prematurely (and undesirably) fracture the webs during the capping operation.

Like the arrangement disclosed in the Berglund '401 patent, structural members independent of the breakaway tabs 12 are relied upon to transmit rotational forces from the cap to the tamper-evident ring during a capping operation.

OBJECTS OF THE INVENTION

It is a general object of this invention to provide a tamper-evident closure which is easy to construct and reliable in operation.

It is a more specific object of this invention to provide a tamper-evident closure which precludes premature breaking of bridging members between a cap and tamper-evident ring during a capping operation.

SUMMARY OF THE INVENTION

The above and other objects of this invention are achieved by a tamper-evident closure that is rotatable in a first direction to secure the closure to a container, and that is rotatable in a direction opposite to said first direction for removing the closure from the container. The closure includes a cap having a peripheral skirt with threads on an inner surface thereof for cooperating with threads on a container to which the cap is adapted to be secured. The skirt includes a lower edge which is interrupted by a plurality of upwardly directed recesses, and a tamper-evident ring is positioned below the lower edge of the skirt. A plurality of elongate bridge members interconnect the tamper-evident ring and the cap. In particular, each bridge member includes a lower end forming a lower junction with the ring and an upper end that is thinner than the lower end forming an upper junction with a surface of a recess in the skirt. Each of the bridge members is designed to break adjacent the upper end when the cap of the closure is rotated in a direction to remove it from the container.

Each of the bridge members, in a rearward or counterclockwise direction from the lower junction to the upper junction, is inclined upwardly at an acute angle in the direction in which the cap is desired to be rotated to remove it from the container. Each bridge member also has a step configuration for providing a rearwardly facing surface closely adjacent the upper junction thereof, for engaging the surface of the recess at which the upper junction is formed when the cap of the closure is rotated in a capping direction (i.e., clockwise) to secure the closure to a container, to thereby cause the cap and tamper-evident ring to rotate as a single unit, without imposing undesired compressive forces on the bridge members which could possibly cause premature fracturing of the bridge members during the capping operation.

In a preferred embodiment of the invention each recess is provided by a continuously curved surface extending upwardly from the lower edge of the skirt, and the rearwardly facing surface of the each bridge member lies in a plane which is at an angle other than 90 degrees to the central axis of the corresponding bridge member, in side elevational view.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 3 is an enlarged fragmentary elevational view illustrating the arrangement of the closure as it is being applied to the container;

FIG. 5 is an enlarged fragmentary elevational view illustrating the condition of the closure during an intermediate step in the removal of the closure from the container;

FIG. 6 is an enlarged fragmentary elevational view showing the condition of the closure after the breakaway tabs have fractured;

DESCRIPTION OF THE PREFERRED EMBODIMENT OF THE INVENTION

Figure 1:
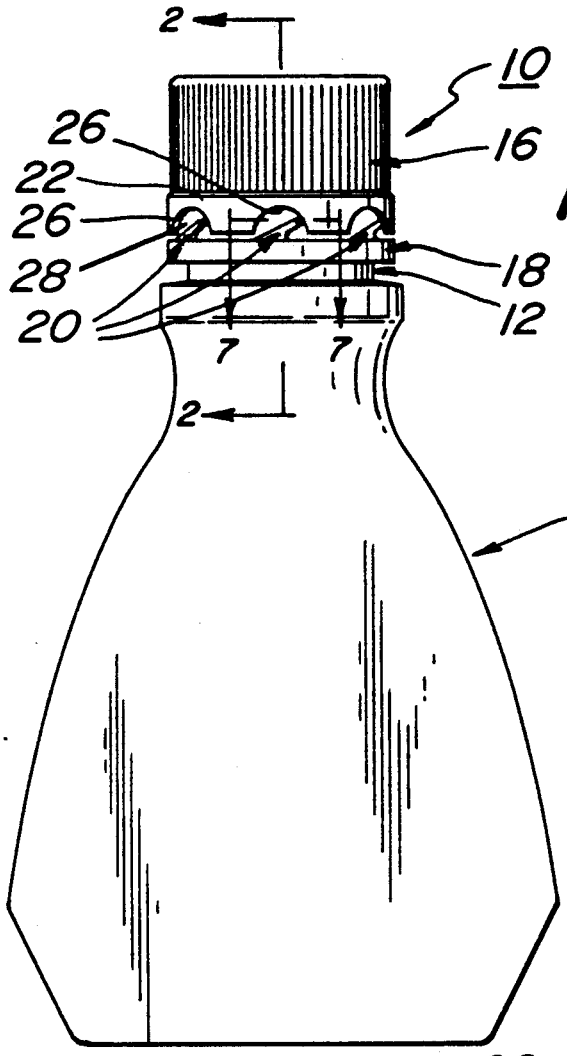
FIG. 1 is a front elevational view of a closure in accordance with this invention, being attached to a container.

Referring now in greater detail to the various figures of the drawings wherein like reference characters refer to like parts, a tamper-evident closure embodying the present invention is generally shown at 10 in FIG. 1, being attached to finish 12 of a bottle 14. The closure 10 comprises a internally threaded cap 16 connected to a tamper indicating ring 18 through a plurality of circumferentially spaced-apart, inclined breakaway bridge members or tabs 20.

Figure 2:
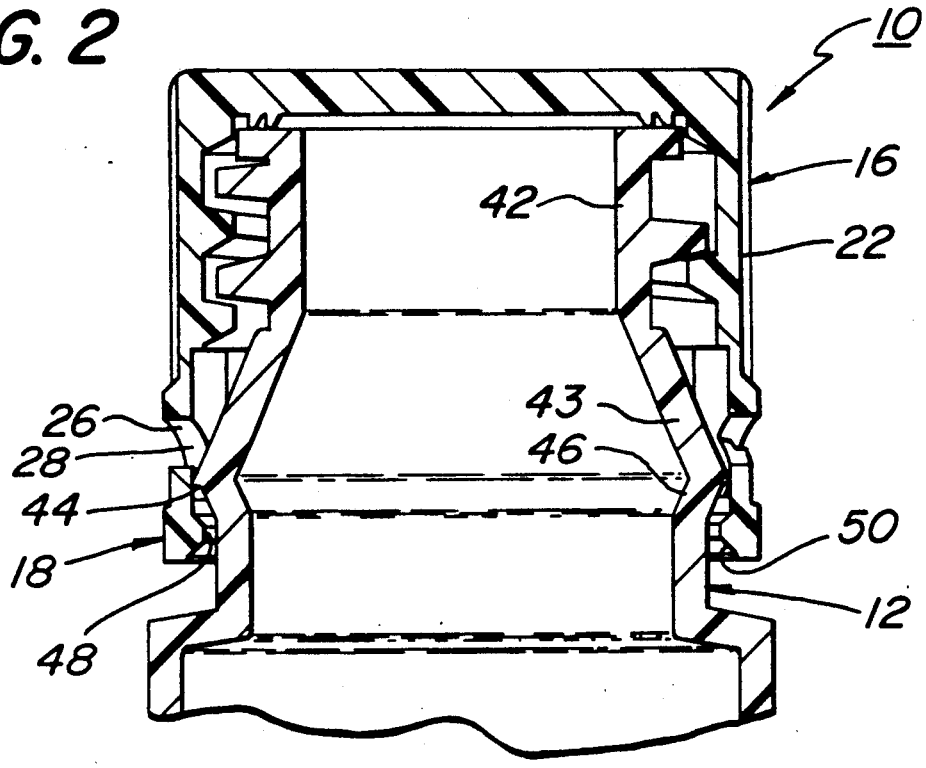
FIG. 2 is a sectional view along line 2—2 of FIG. 1.

Referring specifically to FIGS. 1 and 2 the cap 16 includes a downwardly depending peripheral skirt 22 having a lower generally planar edge 24. The planar edge is interrupted by spaced apart, upwardly directed, curved surfaces 26 defining a plurality of recesses 28. As will be explained in detail hereinafter, the number of recesses 28 corresponds to the number of breakaway tabs employed in the closure 10. In the illustrated embodiment there are six (6) such recesses.

Figure 7:
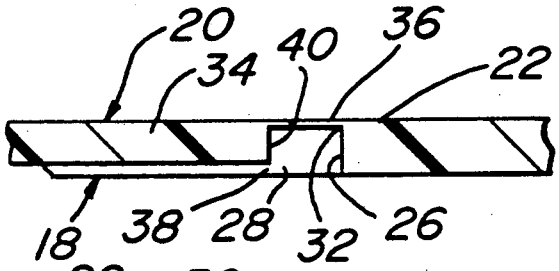
FIG. 7 is a sectional view along line 7—7 of FIG. 1, showing the orientation of the breakaway tabs when the closure is in a relaxed condition, fully secured to the container.

Referring specifically to FIGS. 5 and 7, each of the breakaway tabs 20 has a lower end integrally molded to the tamper-evident ring 18 at a lower junction 30. The upper end of each breakaway tab 20 is integrally molded to the peripheral skirt 22 of the cap 16 in a region of a recess 28, to form an upper junction 32 with said cap. Each of the breakaway tabs 20 extends upwardly and rearwardly from the tamper-evident ring 18 to the peripheral skirt 22 of the cap 16 at an acute angle of approximately 30°, such that the upper junction 32 is the trailing end of the bridge 20, relative to the direction of rotation of the cap 16 as said cap is being secured on to the finish 12 of the bottle 14.

Still referring to FIGS. 5 and 7, each of the breakaway tabs 20 includes a thick, forward section 34 extending rearwardly from the tamper-evident ring 18 and being connected to a thin, rearward section 36 through a step 38 that defines a rearwardly facing surface 40. In the preferred embodiment of the invention the rearwardly facing surface 40 is disposed at a desired angle for cooperatively engaging with the curved surface 26 of a corresponding recess 28 during assembly of the closure 10 to the bottle 14, in a manner which will be described in detail hereinafter. In an exemplary embodiment the rearwardly facing surface 40 of the step is disposed at an angle of approximately 36½ degrees to a vertical axis 41, passing through a lower edge of the step 38, as is illustrated in FIG. 5.

Referring specifically to FIG. 2, the finish 12 of the bottle 14 includes an upper threaded section 42 for cooperating with internal threads of the cap 16. An outwardly flaring conical section 43 forms a downward extension from the threaded section 42, and said conical section 43 forms an outer junction 44, in the form of a peripheral rib, with an inwardly directed, frustro conical section 46.

Still referring to FIG. 2, the tamper-evident ring 18 of the closure 10 includes a inwardly directed rib 48 having a lower inclined surface 50 which is adapted to engage and slide over the outwardly flaring conical section 43 of the finish, and thereafter snap into locking engagement with the finish 12, in a region below the peripheral rib 44.

Figure 8:
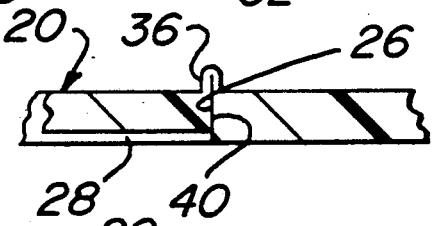
FIG. 8 is a sectional view similar to FIG. 7, but showing the orientation of the breakaway tabs as the closure is being applied to the container.
Figure 4:
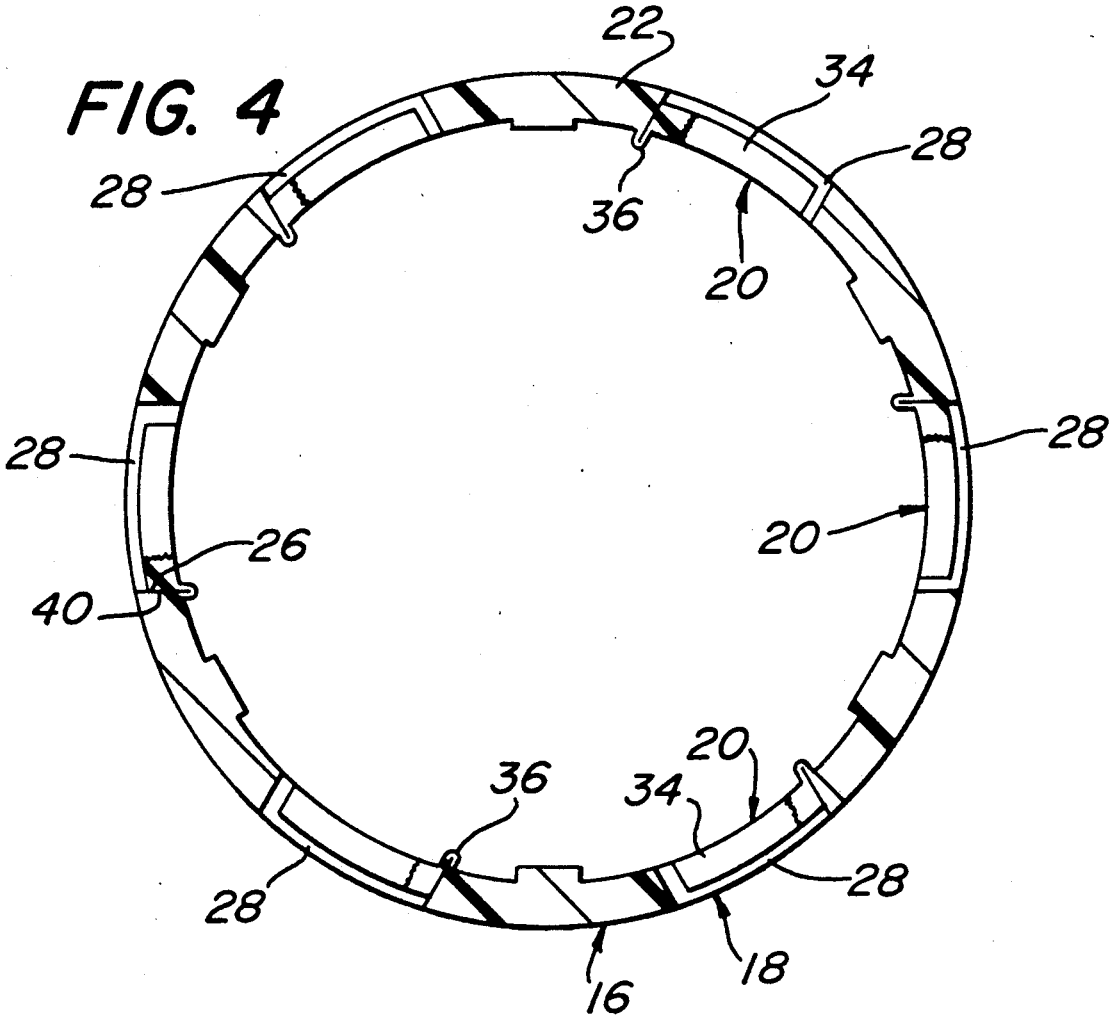
FIG. 4 is a sectional view taken along line 4—4 of FIG. 3.

Referring to FIGS. 3, 4 and 8, the closure 10 is initially applied to the finish 12 of the bottle 14 by pressing the closure in a downward direction over the finish, while at the same time rotating the cap 16 in a clockwise direction, as is illustrated by arrow 51 in FIG. 3. As the closure 10 is being inserted on to the finish in a downward direction, an opposing upward force is applied to the tamper-evident ring 18 as a result of its engagement with the outwardly flaring conical section 43 of the finish. This upward force tends to compress, or move the tamper-evident ring 18 in an upward direction, thereby decreasing the space between the lower edge 24 of the cap 16 and the upper edge of the tamper-evident ring 18. This imparts a compressive load to each of the breakaway tabs 20, which, in conjunction with the clockwise rotation of the cap 10 causes the thin rearward section 36 of each of the tabs to buckle or fold into an orientation which causes the rearwardly facing surface 40 of the step 38 to actually engage a curve surface 26 of a corresponding recess 28. This cooperative arrangement between the rearwardly facing surface 40 of the step 38 and the upwardly directed curve surface 26 of the recess 28, which is extremely important in this invention, is best shown in FIGS. 4 and 8. In particular, engagement of the rearwardly facing surface 40 with the curved surface 26 provides a driving connection between the cap 16 and tamper-evident ring 18 to prevent the breakaway tabs 20 from breaking as the closure 10 is assembled with the bottle 14. As was stated earlier, the rearwardly facing surface 40 is disposed at a desired angle for establishing substantial area contact with the upwardly directed curve surface 26 of the recess 28, to thereby effectively transmit the driving force to the thick forward section 34 of each of the breakaway tabs 20.

After the closure 10 has been connected to the bottle 14 it assumes a relaxed state, as is shown best in FIGS. 1 and 7. In this state it should be noted that each of the breakaway tabs 20 is in a substantially linear, nonstressed orientation.

Referring to FIG. 5, the closure 10 is shown in an intermediate condition during removal of the closure from the bottle. Specifically, as the cap 16 is rotated in a counterclockwise direction, as is illustrated by arrow 52 in FIG. 5, the cap is moved upwardly as a result of its threaded engagement with the upper threaded section 42 of the finish 12. This upward movement causes the tamper-evident ring 18 to initially move in an upward direction, until it meets resistance to further upward movement by the engagement of its inwardly directed rib 48 with the outer surface of the frustro conical section 46. At this point further upward movement of the cap 16, resulting from the counterclockwise rotation thereof, causes the breakaway tabs 20 to become stressed, thereby applying a tensile force at the upper junction 32 between each of the breakaway tabs 20 and the curved surface 26 of a corresponding recess 28.

Figure 9:
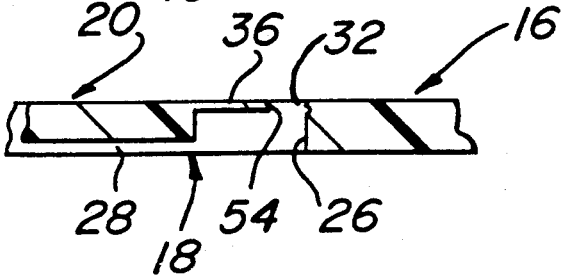
FIG. 9 is a sectional view similar to FIG. 7, showing the orientation of the breakaway tabs after they have fractured during removal of the closure from the container.

Referring to FIG. 6 and 9, continuous, clockwise rotation, in the direction of arrow 52, causes the tensile force imposed at the junction 32 to exceed the breaking strength at the junction, thereby causing each of the breakaway tabs to fracture at 54. Once the breakaway tabs 20 fracture the cap 16 can be removed from the bottle 14, leaving the tamper-evident ring 18 on the finish to provide a visible indication that the closure has been removed from the bottle.

A very important feature of this invention is in providing the rearwardly facing surfaces 40 of the steps 38 directly on the breakaway tabs 20, so that a driving force is directly established between the curved surfaces 26 of the recesses 28 and the thick forward sections 34 the breakaway tabs 20. In other words, since the rearwardly facing surfaces 40 actually are located at the junctions between the thick forward sections 34 and the thin rearward sections 36 of the breakaway tabs, the compressive load imposed upon the breakaway tabs 20, by the engagement of curved surfaces 26 with the steps 38, is taken up directly by the thick forward sections 34 of such tabs.

Without further elaboration, the foregoing will so fully illustrate my invention that others may, by applying current or future knowledge, adopt the same for use under various conditions of service.

What we claim as the invention is:

1. A tamper evident closure rotatable in a first direction to secure the closure to a container and rotatable in a direction opposite said first direction to remove the closure from the container, said closure including:

a cap having a peripheral skirt, said skirt having threads on an inner surface thereof for cooperating with threads on a container to which said cap is adapted to be secured, said skirt having a lower edge interrupted by a plurality of upwardly directed recesses, said recesses including surfaces spaced upwardly from said lower edge;

a tamper evident ring disposed below the lower edge of the skirt; and a plurality of elongate bridge members interconnecting said tamper evident ring and said cap, each said bridge members including a lower end forming a lower junction with said ring and an upper end thinner than said lower end forming an upper junction with a surface of a recess in said skirt, each of said bridge members being designed to break at the upper end thereof when said closure is rotated in said opposite direction to remove the cap from a container, each of said bridge members, in said opposite direction, being inclined upwardly at an acute angle to said ring from said lower junction to said upper junction, each of said bridge members having a stepped configuration for providing a bridge surface closely spaced to and facing the surface of the recess at which the upper junction is formed for engaging the surface of the recess at which the upper junction is formed as the closure is being rotated in said first direction to secure said closure to said container, to thereby limit the permissible relative movement between the cap and the ring to prevent the bridge members from fracturing at the upper junctions when the closure is being secured to a container.

2. The closure of claim 1, characterized in that each recess is provided by a continuously curved surface extending upwardly from the lower edge of the skirt, said bridge surface of each bridge member being in a plane which is at an angle other than 90 degrees to the central elongate axis of its corresponding bridge member, in side elevational view.

3. The closure of claim 1, characterized in that said tamper evident ring includes an inwardly directed rib for being engaged by a retention member forming part of the container to which the closure is adapted to be secured, to thereby retain the ring on the container when the cap is removed from said container.

* * * * *